US012235089B1

(12) United States Patent
Vance et al.

(10) Patent No.: US 12,235,089 B1
(45) Date of Patent: Feb. 25, 2025

(54) SHOCK INITIATION OF NON-ELECTRIC SHOCK TUBE

(71) Applicant: Honeywell Federal Manufacturing & Technologies, LLC, Kansas City, MO (US)

(72) Inventors: Joshua Dale Vance, Peculiar, MO (US); Paul Thomas Heffernan, Fairway, KS (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 18/164,772

(22) Filed: Feb. 6, 2023

(51) Int. Cl.

| | |
|---|---|
| ***F42B 3/12*** | (2006.01) |
| ***C06C 5/06*** | (2006.01) |
| ***F42B 3/10*** | (2006.01) |
| ***F42B 3/13*** | (2006.01) |
| ***F42C 19/12*** | (2006.01) |
| ***F42D 1/04*** | (2006.01) |
| ***F42D 1/045*** | (2006.01) |
| *C06C 7/00* | (2006.01) |
| *F42D 1/055* | (2006.01) |

(52) U.S. Cl.
CPC ..... *F42D 1/043* (2013.01); *C06C 5/06* (2013.01); *F42B 3/10* (2013.01); *F42B 3/121* (2013.01); *F42B 3/122* (2013.01); *F42B 3/13* (2013.01); *F42C 19/12* (2013.01); *F42D 1/04* (2013.01); *F42D 1/045* (2013.01); *C06C 7/00* (2013.01); *F42D 1/055* (2013.01)

(58) Field of Classification Search
CPC ..... C06C 5/06; C06C 7/00; F42D 1/04; F42D 1/042; F42D 1/043; F42D 1/045; F42D 1/05; F42D 1/055; F42C 19/12; F42B 3/12; F42B 3/121; F42B 3/122; F42B 3/124; F42B 3/125; F42B 3/13
USPC ..... 102/206
See application file for complete search history.

(56) References Cited

U.S. PATENT DOCUMENTS

| | | | | |
|---|---|---|---|---|
| 4,924,774 A * | 5/1990 | Lenzen | B60R 21/33 | 102/202.7 |
| 5,144,893 A * | 9/1992 | Zeman | F42D 1/04 | 102/202 |
| 5,341,742 A * | 8/1994 | Alford | F42B 3/10 | 102/202.8 |
| 6,584,905 B1 * | 7/2003 | Snyder | C06C 5/04 | 102/275.12 |

(Continued)

FOREIGN PATENT DOCUMENTS

| | | | |
|---|---|---|---|
| WO | WO-9323718 A2 * | 11/1993 | C06C 5/04 |

*Primary Examiner* — James S Bergin
(74) *Attorney, Agent, or Firm* — Erise IP, P.A.

(57) ABSTRACT

Embodiments of the disclosure are directed to a shock initiation system for initiating shock in a shock tube for demolition. In some embodiments, the shock initiation system comprises a reusable discharge unit and a replaceable shock initiation platform. The reusable discharge unit may comprise a power source, a timer, a switch, and user inputs and may function to store a time, countdown the timer, and generate and transmit an electrical energy to the replaceable shock initiation platform. The shock initiation platform may receive the electrical energy from the discharge unit overpowering a resistor disposed on the shock initiation platform. The resistor may then detonate providing an initiation shock to a proximally disposed shock tube, thereby initiating shock in the shock tube.

20 Claims, 8 Drawing Sheets

(56) References Cited

U.S. PATENT DOCUMENTS 8,408,132 B2 * 4/2013 Lucas ..... F42B 3/12
102/275.12

* cited by examiner

SHOCK INITIATION OF NON-ELECTRIC SHOCK TUBE

STATEMENT OF GOVERNMENT SUPPORT

This invention was made with Government support under Contract No.: DE-NA-0002839 awarded by the United States Department of Energy/National Nuclear Security Administration. The Government has certain rights in the invention.

BACKGROUND

1. Field

Embodiments of the disclosure relate to shock initiation of a non-electric shock tube. Specifically, embodiments of the disclosure relate to shock initiation of a non-electric shock tube by detonating a resistor in a shock initiation system.

2. Related Art

Typical shock tubes require an initiator to initiate a shock wave in the shock tube. The shock wave then travels the length of the shock tube to an explosive device that detonates providing a desired blast. However, there are several drawbacks to using these typical initiation systems.

Typically, a mechanical explosion or an electric shock device is used to initiate shock in a shock tube. The mechanical devices can be spring loaded firing pins that actuate shotgun shell primers. These mechanical shock initiation methods tend to be unreliable and the user, or users, must move several hundred feet away from the shock initiator before detonation. If the initiator does not detonate, the user must return to the mechanical shock initiation device and replace the primer, reset the timer, and move back to a safe location. To increase reliability, two primers may be used. Occasionally, both primers may fail to initiation shock in the shock tube. Consequently, both primers need replacing. This process potentially puts the user in harm's way when detonation does not initially occur. Furthermore, excess time is spent for setup and safety when loading and reloading the mechanical shock initiation devices.

Alternatively, electric blast initiators may be used. Electric blast initiators typically emit a high voltage energy pulse across a spark gap to initiate shock in the shock tube. Typically, electrodes are connected to an end of the shock tube and high voltage is provided by a power source. A spark is initiated between the electrodes resulting in ignition of combustive material within the shock tube. The electrical shock initiation devices typically require 4 to 9 kilovolts of electric potential and 6 to 10 Joules of energy. What is needed is a reusable electric shock initiation system that provides reliability at relatively low electrical energy levels.

SUMMARY

Embodiments of the current disclosure solve the above-mentioned problems by providing an electric shock initiation system comprising a replaceable shock initiation platform comprising electrical leads and a resistor configured to detonate when a minimum threshold voltage is applied. The resistor may be configured such that when the resistor fails the energy from the exploding resistor is transferred into a shock tube resulting in shock initiation of the shock tube.

Accordingly, a shock wave translates along the length of the shock tube detonating an explosive device.

A first embodiment is directed to a replaceable shock initiation platform of a shock initiation system for initiating shock in a shock tube. The replaceable shock initiation platform comprises a platform configured to support electrical components, electrical leads in electrical communication with a power source, and a resistor coupled to the electrical leads and disposed on the platform, wherein the resistor is disposed at a proximal end of the shock tube, and wherein the resistor is configured to detonate when a minimum electrical energy is provided to the resistor by the power source via the electrical leads.

A second embodiment is directed to shock initiation system for initiating shock in a shock tube. The shock initiation system comprises a discharge unit. The discharge unit comprises a power source configured to provide electrical energy, a switch, and a timer configured to activate the switch after a predetermined time. The shock initiation system further comprises a shock initiation platform comprising. The shock initiation platform comprises a platform configured to support electrical components, electrical leads coupled to the discharge unit, and a resistor coupled to the electrical leads and disposed on the platform, wherein the resistor is configured to detonate when the electrical energy is provided by the power source to the resistor via the switch and the electrical leads.

A third embodiment including any of the first through the second embodiments, wherein the resistor is a metal film resistor.

A fourth embodiment including any of the first through third embodiments, wherein a resistance of the resistor is in a range of, for example, 1 to 15 ohms, and wherein the minimum electrical energy provided to detonate the resistor is in a range of 120 to 200 milliJoules.

A fifth embodiment including any of the first through fourth embodiments, wherein the platform, or the shock initiation platform is configured to be selectively coupled to the discharge unit comprising the power source.

A sixth embodiment including any of the first through the fifth embodiments, wherein the minimum electrical energy is above a minimum threshold for detonating the resistor based at least in part on a resistance of the resistor and a minimum energy to activate reactive material in the shock tube.

A seventh embodiment including any of the first through the fifth embodiments, wherein the switch is an electromechanical switch and a user input device configured to receive time information and coupled to the timer, and a processor communicatively coupled to the timer and the switch for relaying the electrical energy to the resistor.

An eighth embodiment including any of the first through sixths embodiments and further including a processor configured to actuate the switch, and a communication device communicatively coupled to the processor, wherein the electrical energy is provided to the resistor based on remote communication received by the communication device and actuation of the switch by the processor.

A ninth embodiment is directed to method of initiating shock in a shock tube by a shock initiation system. The method comprising receiving, by a timer, a time for a countdown to actuate a switch of an electrical circuit, actuating the switch when the countdown is complete, providing electrical energy from a power source to a resistor when the switch is actuated, detonating the resistor by the electrical energy, and provide detonation energy from detonation of the resistor to the shock tube for remotely detonating an explosive A tenth embodiment including the ninth embodiment, wherein the electrical energy is above a minimum threshold for detonating the resistor based at least in part on a resistance of the resistor, and wherein the resistance of the resistor is in a range of, for example, 1 to 15 ohms, and wherein the electrical energy provided to detonate the resistor is in a range of 120 to 200 milliJoules and is provided as a pulse with a rise time in a range of 10 to 100 nanoseconds, and wherein the time is received by a communication device communicatively coupled to the timer, and wherein the timer is digital and programmable, and the switch is a digital switch.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
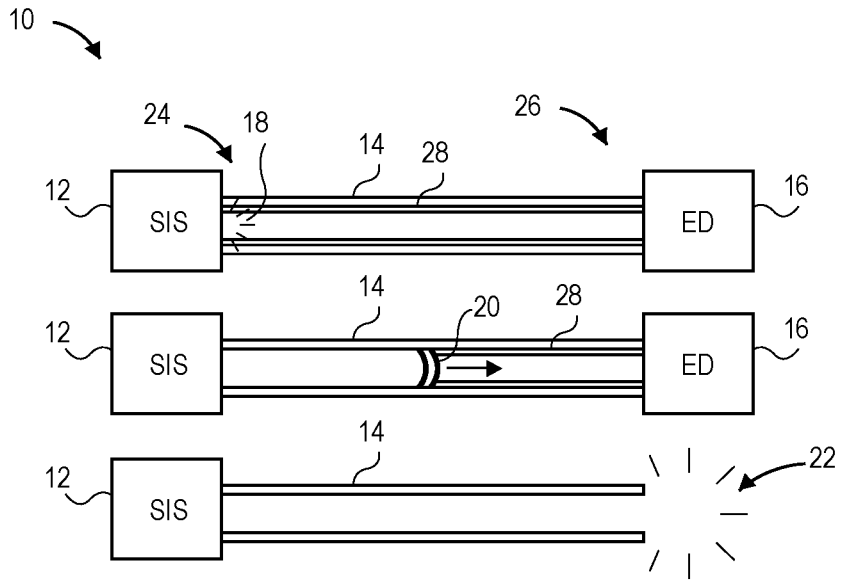
FIG. 1 depicts an exemplary process of detonating an explosive device with a shock initiation system.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the embodiments can be practiced. The embodiments are intended to describe aspects of the disclosure in sufficient detail to enable those skilled in the art to practice the current disclosure. Other embodiments can be utilized, and changes can be made without departing from the scope of the current disclosure. The following detailed description is, therefore, not to be taken in a limiting sense. The scope of the disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Generally, embodiments of the current disclosure relate to an electric shock initiation system comprising a replaceable shock initiation platform. In some embodiments, the shock initiation platform comprises at least one electrical lead configured to provide electrical energy to a resistor disposed on the shock initiation platform. The electrical energy may be greater than a minimum threshold energy that causes the resistor to fail. The resistor may be a metal film resistor or similarly may comprise a metal film. When the minimum threshold energy is provided to the resistor, the metal film may detonate providing an initiation shock initiating the shock tube. The resistor may be in contact with or near a proximal end of the shock tube. The resulting energy from the exploding resistor may create a shock in the shock tube that travels the length of the shock tube detonating an explosive device at a distal end of the shock tube.

Referenced herein as a shock, a shock wave may comprise a heat and pressure wave higher than relative local atmospheric temperature and pressure. The initiation shock generated by the exploding resistor may expand outward from the resister and enter the proximal end of the shock tube which may be a standard non-electric (Nonel) shock tube. The initiation shock may comprise a minimum energy to generate a contained shock in the shock tube by rapidly increasing the pressure and temperature of a reactive mixture disposed on the inner walls of the shock tube. This creates a contained shock that propagates the length of the shock tube to impact, and detonate, the explosive device.

FIG. 1 depicts demolition system 10 comprising exemplary shock initiation system (SIS) 12, shock tube 14, and explosive device 16. In some embodiments, SIS 12 causes initiation shock 18 at proximal end 24 of shock tube 14. Initiation shock 18 may activate contained shock 20 in shock tube 14, which in some embodiments, may be a NoNel shock tube as described above. Shock 20 may propagate the length of shock tube 14 and detonate explosive device 16 resulting in explosion 22.

In some embodiments, shock tube 14 may be of any type. Here, SIS 12 may provide the minimum energy to activate the reactive mixture 28 in shock tube 14. Shock tube 14, in some embodiments, may include inert gas or explosives in a high-pressure chamber or as stated above and shown in FIG. 1, shock tube 14 may be a NoNel shock tube. Shock 20 may propagate the length of shock tube 14 impacting explosive device 16 via any type of shock tube 14. Shock tube 14 may comprise a hollow plastic multi-layer tube coated on the innermost wall with a trace amount of reactive mixture 28 (e.g., high melting explosive (HMX), 16 milligrams/meter). When the reactive mixture 28 is ignited, shock 20 propagates the length of shock tube 14 at a high rate (e.g., 2,000 meters/second). Shock 20 may impact and detonate explosive device 16 at distal end 26 of shock tube 14.

In some embodiments, any type of explosives may be used. Explosive device 16 may be impacted by shock 20. Consequently, explosive device 16 may explode. In some embodiments, explosive device 16 may be dynamite, plastic explosives, black powder, fireworks, or any other explosive material. Furthermore, embodiments of the disclosure described herein may be applied to various fields. For example, SIS 12 may be used for any intended purpose including commercial blasting, military demolition, special effects, airbag deployment, ejection seat deployment, improvised explosive devices, fireworks, and any other field where combustion is needed. Generally, SIS 12 is an initiator of explosive device 16. In some embodiments, the energy required to detonate explosive device 16 may determine the type of shock tube 14, which in turn may dictate the energy provided by SIS 12. As such, the energy provided to the resistor and the type of resistor may be based at least in part on the explosive device 16 and the field of use of explosive device 16.

Figure 2:
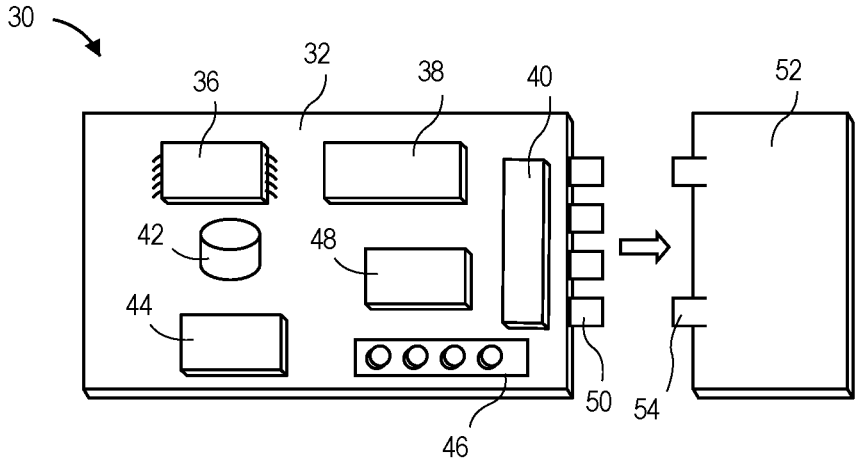
FIG. 2 depicts an embodiment of a detonation device of the shock initiation system of FIG. 1.

FIG. 2 depicts SIS 12 comprising shock initiation device 30 comprises discharge unit 32 and shock initiation platform 52. In some embodiments, discharge unit 32 may be a capacitive discharge unit (CDU). Discharge unit 32 may comprise processor 36, communication device 38, switch 40, memory 42, power source 44, user interface 46, display 48, discharge unit leads 50, passive electrical components (not shown), and any other necessary components for embodiments described herein. Furthermore, SIS 12 may comprise shock initiation platform 52 comprising leads 54 for electrically coupling shock initiation platform 52 to discharge unit 32. In some embodiments, discharge unit 32 may be any standard discharge unit capable of providing electrical energy to shock initiation platform 52.

In some embodiments, discharge unit 32 comprises power source 44 providing enough energy to power all components of discharge unit 32 and providing enough electrical energy to reach a minimum power output to overpower resistor 56 (FIG. 3A) on shock initiation platform 52. Power source 44 may be an external power source or may be a battery disposed at discharge unit 32. Power source 44 may be a single power source or may be a plurality of power sources and may power all electrical components of SIS 122.

In some embodiments, discharge unit 32 comprises processor 36 and memory 42. Memory 42 may be a stand-alone memory or may be integrated into processor 36. Memory 42 may store computer-executable instructions that, when executed by processor 36, performs methods described herein. For example, processor 36 may receive input from the user by electrical signal from user interface 46. The user input may be processed, and data may be displayed by display 48 including a time and/or a countdown based on the user input. After the time has passed, processor 36 may direct the electric power from power source 44 to shock initiation platform 52 by controlling switch 40. In some embodiments, switch 40 comprises a mechanically activated switch shown in FIG. 6C, and described in detail below, a transistor, or may be a digital switch. The digital switch may be any standard integrated chip for controlling electrical signals.

In some embodiments, processor 36 may be electrically coupled to communication device 38. Communication device 38 may be any standard transceiver comprising a transmitter and/or a receiver capable of wireless communication. In some embodiments, communication device 38 may be a short-range device capable of short-range communication such as, for example, BLUETOOTH or radio frequency (RF) transmissions comprising a radio frequency identification card (RFID) readable by an RFID reader. Communication device 38 may receive the user input described above and processor 36 may execute the instructions to set a time, activate a timer, display information, and provide electrical energy to shock initiation platform 52 as described above.

In some embodiments, discharge unit leads 50 may be mechanically coupled to shock initiator leads 54 for providing the electrical energy from discharge unit 32 to shock initiation platform 52. Discharge unit leads 50 may be in electrical communication with power source 44 via switch 40 and the passive electrical components for providing the minimum energy to detonate resistor 54.

Figure 3A:
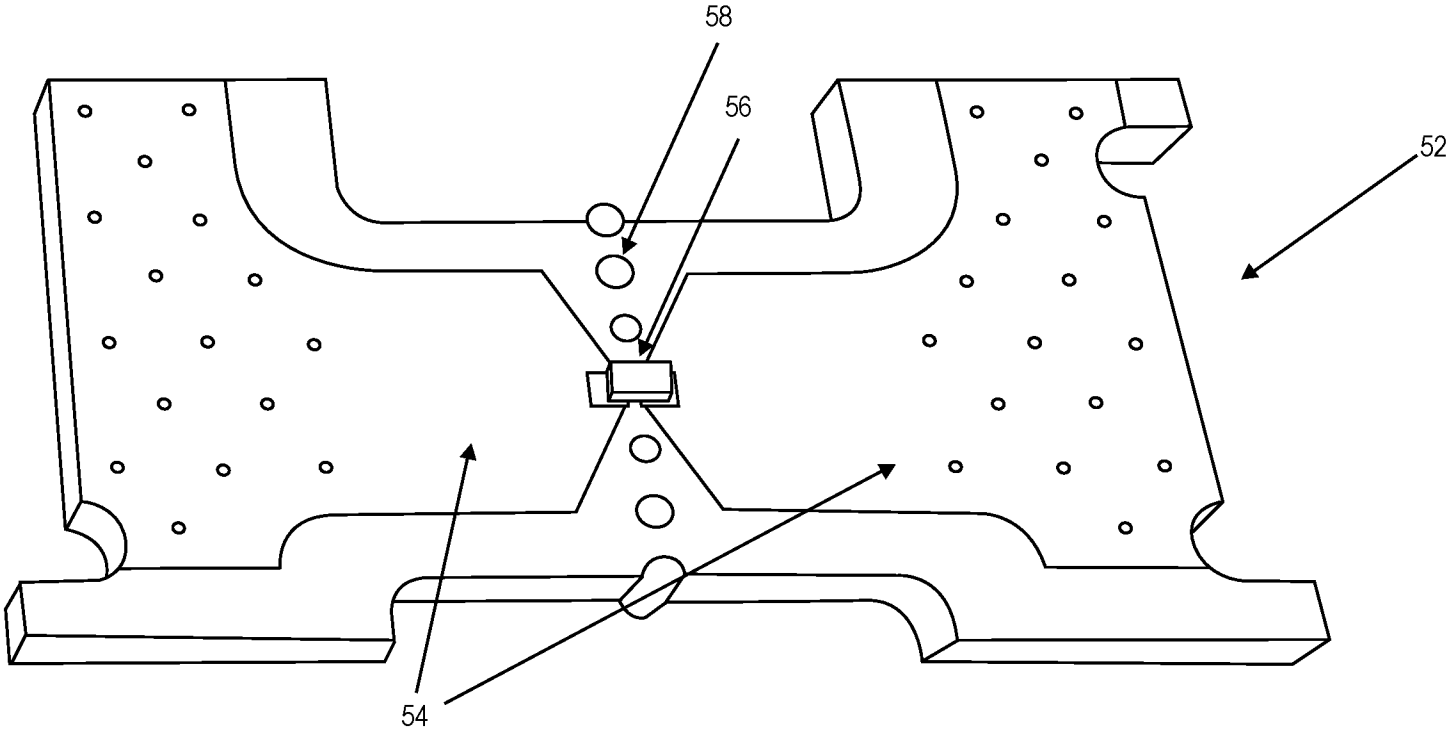
FIGS. 3A and 3B depict an embodiment of the shock initiation platform of the shock initiation system.
Figure 3B:
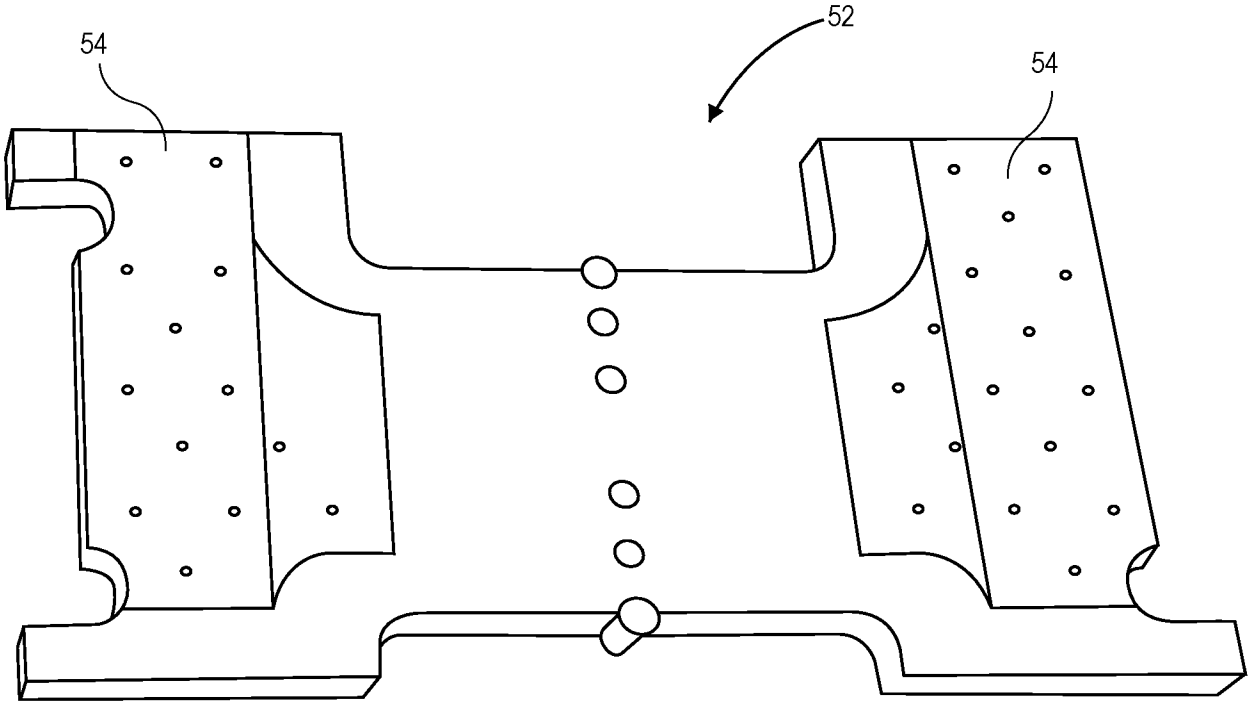

FIGS. 3A and 3B depict an embodiment of shock initiation platform 52. Shock initiation platform 52 may comprise shock initiator leads 54 coupled to discharge unit leads 50 as described above. Shock initiator leads 54 and discharge unit leads 50 may comprise any conductive material such as, for example, copper, lead, gold, nickel, and/or any other conductive material. Shock initiator leads 54, as with discharge unit leads 50, may be configured to carry the minimum electrical energy to detonate resistor 56. In some embodiments, shock initiation platform 52 may be approximately one inch by one inch in are and only a few tenths of an inch thick. This allows shock initiation platform 52 to be disposed in small spaces.

In some embodiments, shock initiator leads 54 may be configured to receive the electrical energy and provide the electrical energy to resistor 56. Shock initiator leads 54 may be configured or arranged in any manner as disposed on shock initiation platform 52. Furthermore, shock initiator leads 54 may be any thickness based on the conductive material to provide the electrical energy as described in embodiments below.

In some embodiments, shock initiator leads 54 may extend to the back of shock initiation platform 52 as shown in FIG. 3B. Shock initiator leads 54 may contact discharge unit leads 50, which may be any kind of electrically conductive material arranged in any form. In some embodiments, shock initiator leads 54 are as shown in FIG. 3B and discharge unit leads 50 are wires or rigid conductors that contact shock initiator leads 54 when shock initiation platform 52 as arranged in SIS housing 68 described below. In some embodiments, shock initiation platform 52 may attach to discharge unit 32. In some embodiments, shock initiation platform 52 may comprise of holes 58 to allow for easy breaking of shock initiation platform 52 after use.

Figure 4:
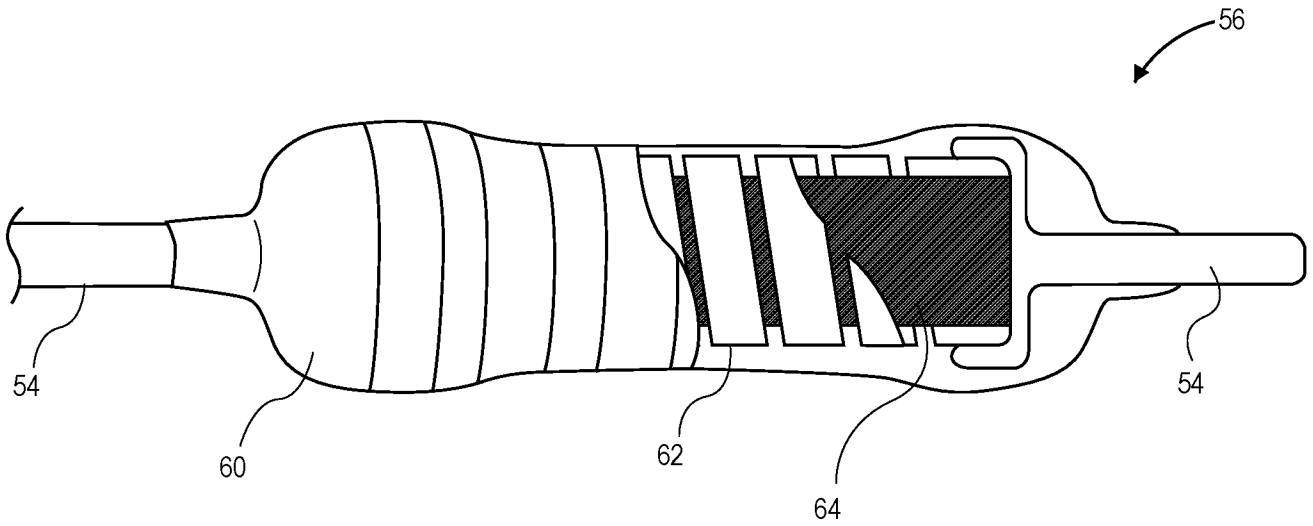
FIG. 4 depicts an exemplary resistor that may be used with the shock initiation system.

FIG. 4 depicts exemplary resistor 56 for some embodiments of the disclosure. Resistor 56 may receive the electrical energy from discharge unit 32 via shock initiator leads 54. In some embodiments, resistor 56 may be a standard resistor comprising metal film 62, ceramic casing 60, and ceramic carrier interior 64. The electrical energy may be received by resistor 56 via shock initiator leads 54, and metal film 62 may be vaporized by the electrical energy resulting in initiation shock 18. In some embodiments, the electrical energy provided is a high-voltage (e.g., approximately 1,500 volts) low-power (e.g., 160 milli-Joules) pulse. The electrical energy may provide a much lower energy pulse than required for typical spark gaps as described above. In some embodiments, the energy in the range of 120 to 200 milliJoules may be provided to resistor 56 as a pulse with a rise time in a range of 10 to 100 nanoseconds. In some embodiments, a minimum voltage and/or minimum power may be applied to resistor 56 to cause detonation of resistor 56 resulting in initiation shock 18. Initiation shock 18 may interact with the proximate end of shock tube 14 activating the reactive mixture 28 of shock tube 14 resulting in shock 20 traveling the length of shock tube 14 causing detonation of explosive device 16.

In some embodiments, resistor 56 may be any standard off-the-shelf resistor. As described above, resistor 56 may be ceramic; however, resistor 56 may be plastic, glass, board, or any other type of standard resistor necessary. In some embodiments, resistor 56 may be configured to provide approximately 10 ohms. In some embodiments, the resistance may be anywhere between 1 and 15 ohms depending on the resistor and the energy required to activate shock 20. Higher resistance may result in lower energy of initiation shock 18. Furthermore, lower ohms may result in high energy initiation shock 18, which may result in ringing and damage discharge unit 32.

Figure 5:
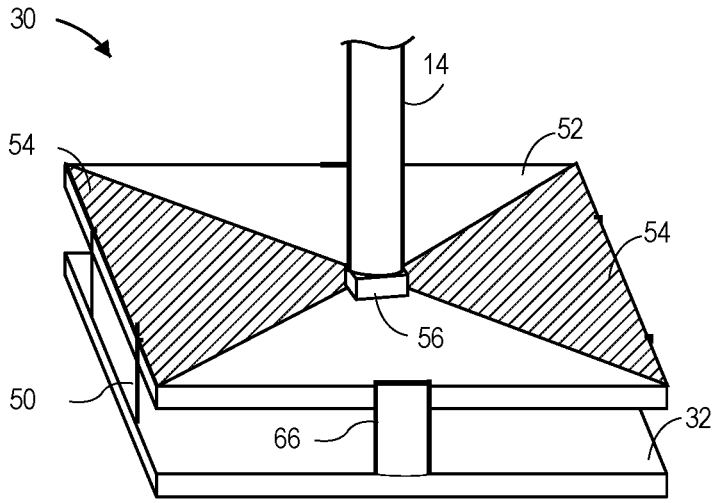
FIG. 5 depicts an exemplary arrangement of components of the shock initiation system.

FIG. 5 depicts a layered configuration of shock initiation device 30 where shock initiation platform 52 is disposed above discharge unit 32. In this arrangement, shock initiation platform 52 may be removed and replaced. In some embodiments, shock initiation platform 52 may clip into position by fasteners 66 extending from discharge unit 32. Shock initiator leads 54 may electrically couple with discharge unit leads 50 when shock initiation platform 52 is clipped into place. This allows a user to snap a new shock initiation platform into place easily after resistor 56 has detonated. Therefore, discharge unit 32 may be reusable while shock initiation platform 52 may be replaced after each use. The arrangement depicted in FIG. 5 is exemplary and any arrangement may be used disposing resistor 56 near or in contact with proximal end 24 of shock tube 14 to activate reactive mixture 28 of shock tube 14.

Figure 6A:
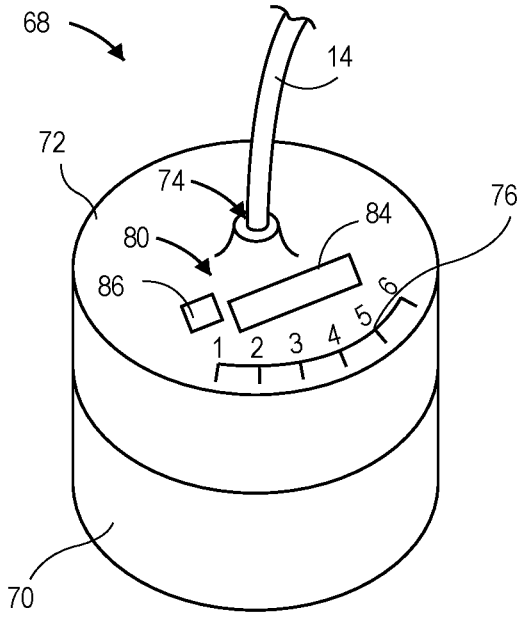
FIGS. 6A-6C depict exemplary housings and an exemplary arrangement of components within the housings.
Figure 6B:
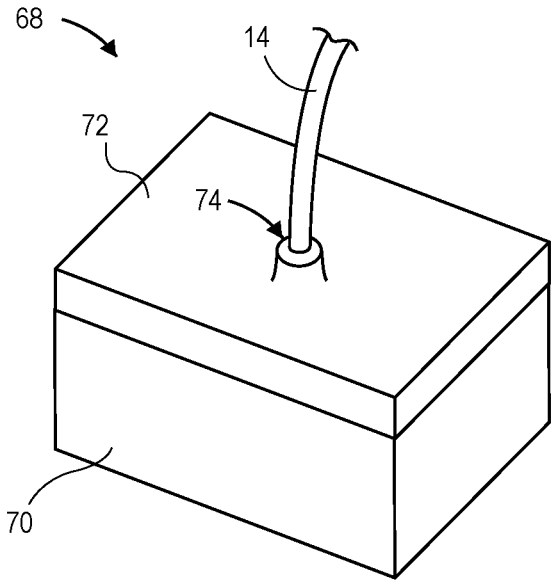
Figure 6C:
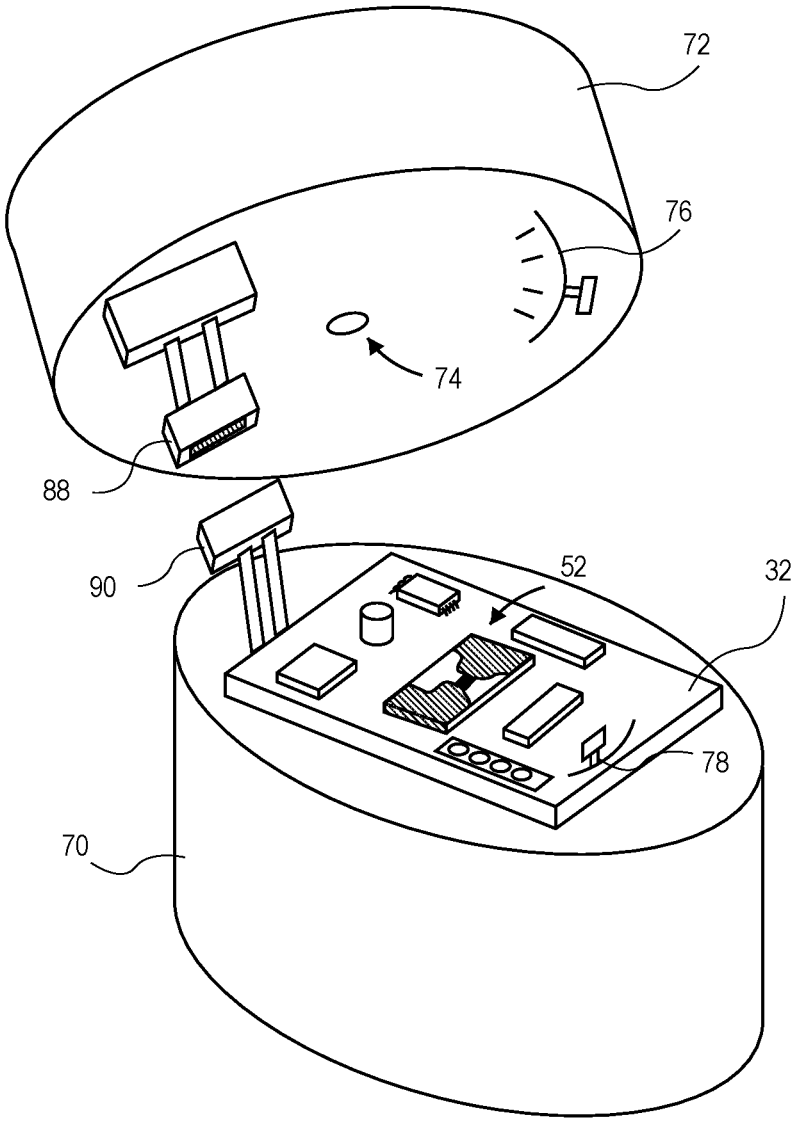

FIGS. 6A, 6B, and 6C depict exemplary embodiments of SIS housing 68 for shock initiation device 30. SIS housing 68 may comprise base 70 and cover 72. Base 70 may support shock initiation device 30 and cover 72 may enclose shock initiation device 30 inside SIS housing 68. Shock tube hole 74 may provide access through cover 72 for shock tube 14 to be placed in proximity to resistor 56. The user may insert shock tube 14 into shock tube hole 74 until shock tube 14 is in position with proximal end 24 in proximity to resistor 56. "In proximity to" may also mean covering or enclosing resistor 56. Shock tube 14 may be inserted through shock tube hole 74 such that when resistor 56 detonates, the resulting initiation shock 18 activates reactive mixture 28 in shock tube 14. Shock 20 then may propagate the length of shock tube 14 detonating explosive device 16 at distal end 26.

In some embodiments, the user may activate timer 78 prior to placing cover 72 and inserting shock tube 14 as described above. In this case, inserting shock tube 14 into shock tube hole 74 may press a switch and activate timer 78. In some embodiments, timer 78 may be set and activated by rotation of cover 72. For example, after shock tube 14 is inserted into shock tube hole 74, the user may interact with cover user interface elements 80 comprising buttons, switches, a touchscreen, and/or dial 76. The user may interact with dial 76, for example, to set timer 78 when cover 72 is closed. Furthermore, the user may interact with cover display 84, which in some embodiments, may be display 84 and may be a touchscreen device. Cover user interface elements 80 may receive a time delay input from the user for detonation of resistor 56 by discharge unit 32. In some embodiments, dial 76 may be connected to timer 78 and the electrical component of cover 72 may be electrically couple to and powered by the electrical components of discharge unit 32 by cover connectors 88 and discharge unit connectors 90. In some embodiments, cover 72 may comprise an independent power source.

The user may activate discharge unit 32 to detonate resistor 56 by communication device 38. In some embodiments, communication device 38 may be a transceiver comprising a transmitter and a receiver, a receiver, or may communicate via short-range communication such as, for example, BLUETOOTH, or radio frequency communication (e.g., RFID). Communication device 38 may receive a signal from a remote device for activating switch 40, setting timer 78, or programing the computer-readable instructions of processor 36. As such, SIS 12 may be programmable by a user at a remote location accessing the programmable features of SIS 12 by any short-range or long-range communication device such as, for example, a computer, a smart phone, a tablet, a radio transmitter, or the like. Therefore, activation of discharge unit 32 to provide the electrical energy to, and detonation of, resistor 56 may be the result of communication from a user at a remote location.

In some embodiments, the user may activate the detonation time by interacting with cover user interface elements 80. For example, setting dial 76 may automatically start timer 78. Alternatively, the user may press button 86. In some embodiments, dial 76 may be set by rotating cover 72. In embodiments, the user may set and activate timer 78 after placing cover 72 and inserting shock tube 14. Therefore, setting and activating timer 78 may be the last action that the user performs before moving away from SIS 12.

Figure 7:
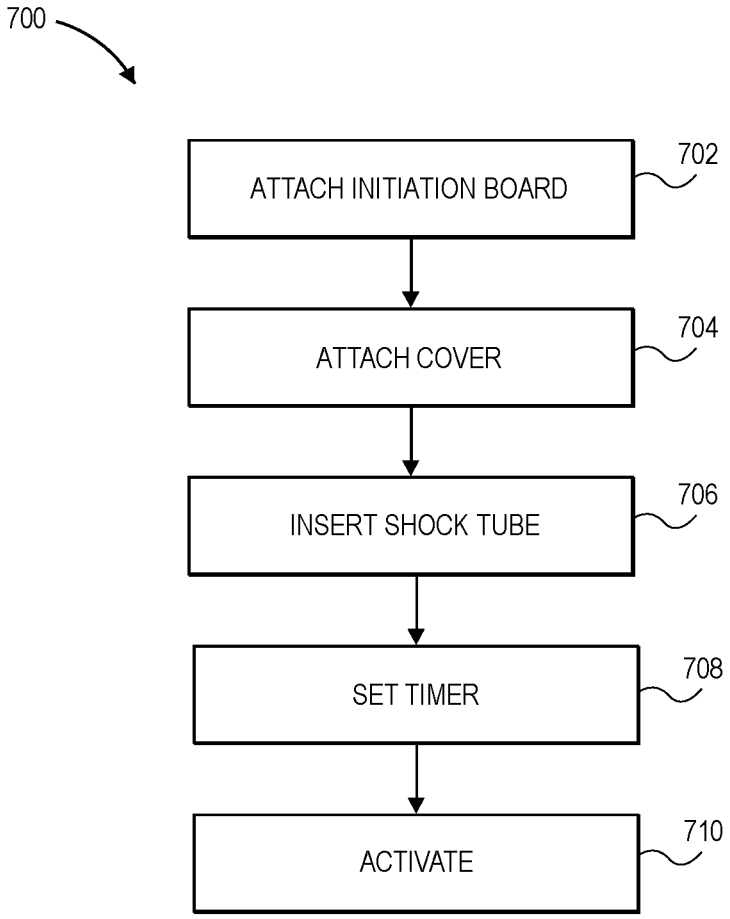
FIG. 7 depicts an exemplary method of preparing the shock initiation system for detonation.

FIG. 7 depicts a flowchart 700 for a method of initiating shock in shock tube 14 by SIS 12. At step 702, the user may attach shock initiation platform 52 to discharge unit 32. Shock initiation platform 52 may be coupled to discharge unit 32 by fasteners 66 or similarly by screws. Fasteners 66 may be any fastening device such as clips (as shown), screws, nuts and bolts, or the like. In some embodiments, the user may press shock initiation platform 52 into fasteners 66, which may bend and separate slightly under force allowing shock initiation platform 52 to bypass hooks holding shock initiation platform 52 in place. Furthermore, discharge unit leads 50 may contact shock initiator leads 54 by snapping into place similarly to fasteners 66 described above. In some embodiments, the user may connect the leads, which may be any standard off-the-shelf electrical connectors as described above.

At step 704, the user may attach cover 72 to base 70. Cover 72 may be any type of cover that may enclose SIS housing 68. Cover 72 may snap onto base 70, screw on, or may simply rest on base 70. Furthermore, cover 72 may comprise shock tube hole 74, dial 76, button 86, and any other cover user input element 80 or display 84 that may be connected to discharge unit 32. In some embodiments, the electronics of cover 72 may remain connected to discharge unit 32 by cover connectors 88 and discharge unit connectors 90 when cover 72 is removed from base 70. In some embodiments, the user may attach the electronics by standard of-the-shelf electrical connectors before attaching cover 72 to base 70. In some embodiments, cover 72 may be only mechanically coupled to base 70 and may provide dial 76, which may be mechanically connected to timer 78.

At step 706, the user may insert shock tube 14 into SIS housing 68 through shock tube hole 74. Proximal end 24 of shock tube 14 may contact resistor 56 or shock initiation platform 52 around resistor 56 enclosing resistor 56 in shock tube 14. As such, when resistor 56 receives the electrical energy from discharge unit 32, resistor 56 detonates creating initiation shock 18 to activate reactive mixture 28 in shock tube 14.

At step 708, the user may set timer 78. The user may interact with cover user interface elements 80 on cover 72 to set timer 78. The user inputs may be mechanical such as dial 76, electromechanical (e.g., buttons, switches), and/or electrical (e.g., touchscreen). In some embodiments, the user may input information via cover user interface elements 80 to set timer 78 mechanically. For example, the user may adjust dial 76 to a particular time by moving an actuator of dial 76 or by rotating cover 72. The user input may be electrically or mechanically coupled to the electrical and/or mechanical components of discharge unit 32.

At step 710, the user activates timer 78 to automatically provide the electrical energy to resistor 56 as described in the exemplary method of activating shock tube 14 described below.

Figure 8:
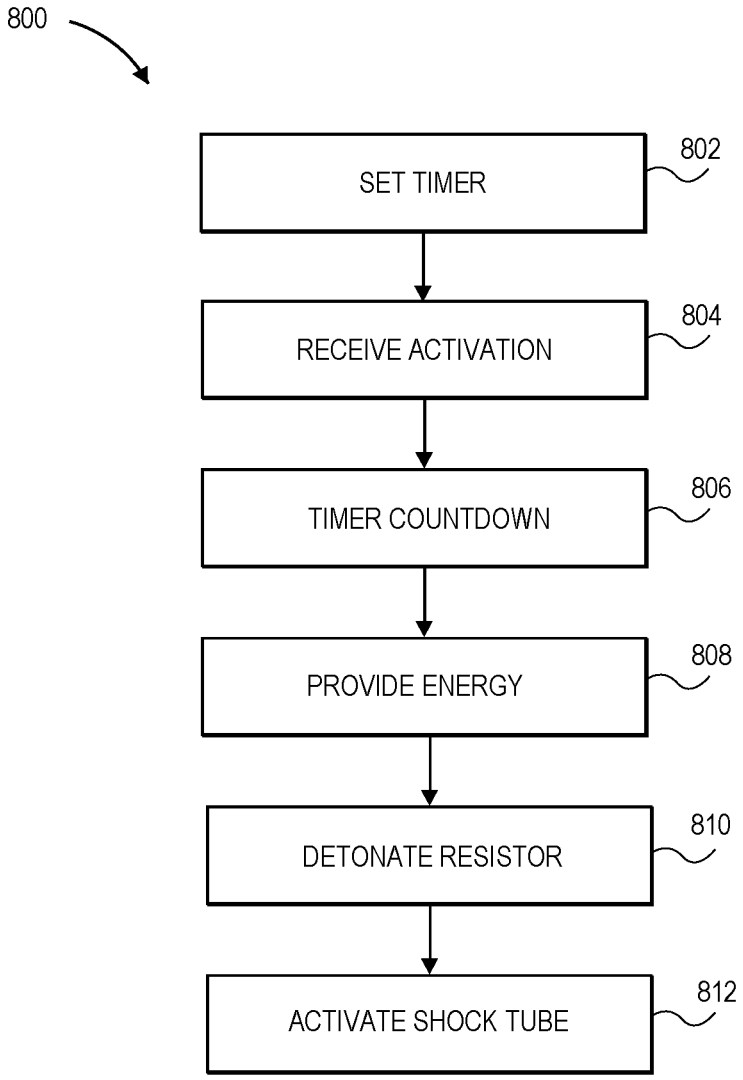
FIG. 8 depicts an exemplary method of causing detonation of an explosive device by the shock initiation system.

FIG. 8 depicts an exemplary flow chart 800 illustrating a method of activating shock tube 14 by detonating resistor 56. At step 802, SIS 12 receives input of by the user setting the timer as described in embodiments above. In some embodiments, cover 72 may provide various cover user interface elements 80 for receiving the user input to set timer 78 or activate SIS 12. In some embodiments, cover 72 may be rotated. Accordingly, as cover 72 is rotated, dial arm of dial 76 may move or trigger timer 78 setting a time by a mechanical motor, a potentiometer, a processor, or other electronic device as described above.

At step 804, SIS 12 may receive activation of time via at least one of cover user interface elements 80 or user interface 46. When the activation input is received time may start a countdown to provide the electrical energy to resistor 56. The countdown may be performed by timer 78, or timer 78 may simply be an input to register a time stored by memory 42 and executable by processor 36.

At step 806, the time may pass before detonation of resistor 56. In some embodiments, the time may count down from any predetermined amount such as, for example, 10 seconds, 20 seconds, or other, based on a predetermined setting. The user may simply input activation and SIS 12 may begin countdown. In some embodiments, the user may set the time based on the intended use and the time it may take for the user to step out of the way. In some embodiments, the time may be programed remotely by wireless communication with communication device 38 in communication with processor 36.

At step 808, the countdown ends and switch 40 is actuated to provide the electrical energy to resistor 56. In some embodiments, switch 40 may be an electro-mechanical switch, or transistor, actuated by a signal provided by processor 36 or timer 78. In some embodiments, switch 40 may be a digital switch, or integrated circuit, as described above. The electrical energy may be provided by power source 44 via passive components such as a capacitor to provide the electrical energy to resistor 56 in the range of 120 to 200 milliJoules as a pulse with a rise time in the range of 10 to 100 nanoseconds. The electrical energy may be provided from discharge unit 32 generating the electrical energy to shock initiation platform 52 comprising resistor 56 via discharge unit leads 50 and shock initiator leads 54.

At step 810, the electrical energy provided to resistor 56 may detonate metal film 62 of resistor 56. The energy released in the detonation of resistor 56 may be based on the properties of resistor 56 and the electrical energy provided to resistor 56. For example, the resistor 56 may be a specifically selected resistance (e.g., 10 ohms) based on the energy required to activate reactive mixture 28 of shock tube 14. Furthermore, the specifically selected resistance may be based the energy required in combination with the electrical energy provided to resistor 56 to generate initiation shock 18. The energy of initiation shock 18 may be determined by the energy required to activate reactive mixture 28 and may be based on the selected resistance of resistor 56 and the electrical energy provided to resistor 56 by discharge unit 32. The electrical energy provided to resistor 56 may be enough to detonate resistor 56 and provide initiation shock 18, but also may be low enough to minimize ringing and damage to discharge unit 32.

At step 812, reactive mixture 28 in shock tube 14 is ignited. Initiation shock 18, generated by resistor 56, contains enough energy to activate reactive mixture 28 causing shock 20 in shock tube 14. Shock 20 then propagates shock tube 14 from proximal end 24 at resistor 56 to distal end 26 at explosive device 16.

Although the disclosure has been described with reference to the embodiments illustrated in the attached drawing figures, it is noted that equivalents may be employed, and substitutions made herein without departing from the scope of the disclosure as recited in the claims.

Having thus described various embodiments of the disclosure, what is claimed as new and desired to be protected by Letters Patent includes the following:

1. A shock initiation system for initiating shock in a shock tube, the shock initiation system comprising:

a discharge unit, comprising:

a power source configured to provide electrical energy;

a switch; and discharge unit leads;

a disposable shock initiation platform configured to selectively couple to the discharge unit, the disposable shock initiation platform comprising:

a platform configured to support electrical components and selectively couple to the discharge unit disposing the platform on a top of the discharge unit;

electrical leads configured to selectively couple to the discharge unit leads providing electrical communication with the power source when the platform is coupled to the discharge unit; and a resistor coupled to the electrical leads and disposed on the platform on a side opposite the discharge unit providing access to the resistor from above the platform, wherein the resistor is disposed at a proximal end of the shock tube, wherein the resistor is configured to detonate when the electrical energy is provided to the resistor by the power source via the discharge unit leads and the electrical leads;

wherein detonation of the resistor provides energy to the shock tube, thereby activating the shock tube; and a housing configured to house the discharge unit and the disposable shock initiation platform, the housing comprising a shock tube hole provided above the resistor configured to receive the shock tube and position the shock tube adjacent the resistor.

2. The shock initiation system of claim 1, wherein the resistor is a metal film resistor.

3. The shock initiation system of claim 2, wherein a resistance of the resistor is in a range of 1 to 15 ohms.

4. The shock initiation system of claim 3, wherein the electrical energy provided to detonate the resistor is in a range of 120 to 200 milliJoules.

5. The shock initiation system of claim 4, wherein the electrical energy is above a minimum threshold for detonating the resistor based at least in part on the resistance of the resistor and a minimum energy to activate reactive material in the shock tube.

6. The shock initiation system of claim 1, further comprising a mechanical timer activated by rotating a cover of the housing.

7. A shock initiation system for initiating shock in a shock tube, the shock initiation system comprising:

a discharge unit, comprising:

a power source configured to provide electrical energy;

a switch;

discharge unit leads; and a timer configured to activate the switch after a predetermined time;

a disposable shock initiation platform configured to selectively couple to the discharge unit, the disposable shock initiation platform comprising:

a platform configured to support electrical components and selectively couple to the discharge unit disposing the platform on a top of the discharge unit;

electrical leads coupled to the discharge unit leads of the discharge unit when the platform is coupled to the discharge unit; and a resistor coupled to the electrical leads and disposed on the platform on a side opposite the discharge unit providing access to the resistor from above the platform, wherein the resistor is configured to detonate when the electrical energy is provided by the power source to the resistor via the switch, the electrical leads, and the discharge unit leads, wherein detonation of the resistor provides energy to the shock tube, thereby activating the shock tube; and a housing configured to house the discharge unit and the disposable shock initiation platform, the housing comprising a shock tube hole provided above the resistor configured to receive the shock tube and position the shock tube adjacent the resistor.

8. The shock initiation system of claim 7, wherein the electrical energy is above a minimum threshold for detonating the resistor based at least in part on a resistance of the resistor and a minimum energy to activate reactive material in the shock tube.

9. The shock initiation system of claim 7, wherein the switch is an electromechanical switch.

10. The shock initiation system of claim 7, further comprising:

a user input device configured to receive time information and coupled to the timer; and a processor disposed on the discharge unit and communicatively coupled to the timer and the switch for relaying the electrical energy to the resistor.

11. The shock initiation system of claim 7, further comprising:

a processor configured to actuate the switch; and a communication device communicatively coupled to the processor, wherein the electrical energy is provided to the resistor based on remote communication received by the communication device and actuation of the switch by the processor.

12. The shock initiation system of claim 7, wherein the resistor is a metal film resistor.

13. The shock initiation system of claim 12, wherein a resistance of the resistor is in a range of 1 to 15 ohms.

14. The shock initiation system of claim 13, wherein the electrical energy provided to detonate the resistor is in a range of 120 to 200 milliJoules.

15. A method of initiating shock in a shock tube by a shock initiation system, the method comprising:

coupling a disposable shock initiation platform to a discharge unit;

coupling discharge leads of the discharge unit to electrical leads of the disposable shock initiation platform to form an electrical circuit;

receiving, by a timer coupled to the electrical circuit, a time for a countdown to actuate a switch of the electrical circuit, wherein the switch and the timer are disposed on the discharge unit;

providing a resistor on a top of the disposable shock initiation platform providing access to the resistor from above;

enclosing the disposable shock initiation platform and the discharge unit in a housing, wherein the housing comprises a shock tube hole providing the shock tube adjacent the resistor;

actuating the switch when the countdown is complete;

providing electrical energy from a power source to the resistor by the discharge leads and the electrical leads when the switch is actuated, detonating the resistor by the electrical energy; and providing detonation energy from detonating of the resistor to the shock tube activating the shock tube.

16. The method of claim 15, wherein the electrical energy is above a minimum threshold for detonating the resistor based at least in part on a resistance of the resistor.

17. The method of claim 16, wherein the resistance of the resistor is in a range of 1 to 15 ohms.

18. The method of claim 17, wherein the electrical energy provided to detonate the resistor is in a range of 120 to 200 milliJoules and is provided as a pulse with a rise time in a range of 10 to 100 nanoseconds.

19. The method of claim 15, wherein the time is received by a communication device communicatively coupled to the timer.

20. The method of claim 15, wherein the timer is digital and programmable, and the switch is a digital switch.

* * * * *